United States Patent [19]

Motomaru

[11] Patent Number: 4,966,084

[45] Date of Patent: Oct. 30, 1990

[54] PALLET FOR SUPPORTING ARTICLE

[75] Inventor: Akira Motomaru, Tsuchiura, Japan

[73] Assignee: Canon Kabushiki Kaisha, Tokyo, Japan

[21] Appl. No.: 326,213

[22] Filed: Mar. 20, 1989

[30] Foreign Application Priority Data

| | | | |
|---|---|---|---|
| Mar. 22, 1988 | [JP] | Japan | 63-067650 |
| Mar. 25, 1988 | [JP] | Japan | 63-038439[U] |
| May 17, 1988 | [JP] | Japan | 63-121094 |
| Dec. 22, 1988 | [JP] | Japan | 63-166623[U] |
| Dec. 23, 1988 | [JP] | Japan | 63-167382[U] |
| Dec. 26, 1988 | [JP] | Japan | 63-168639[U] |

[51] Int. Cl.[5] ..... B65D 19/00

[52] U.S. Cl. ..... 108/51.3; 108/55.3; 108/56.1

[58] Field of Search ..... 108/51.3, 55.3, 55.5, 108/56.1, 57.1

[56] References Cited

U.S. PATENT DOCUMENTS

| | | | |
|---|---|---|---|
| 2,559,930 | 7/1951 | Bolton et al. | 108/57.1 |
| 2,966,276 | 8/1961 | Sorensen et al. . | |
| 3,753,407 | 8/1973 | Tilseth | 108/55.5 X |
| 3,881,429 | 5/1975 | Seymore | 108/51.3 |
| 3,911,834 | 10/1975 | Quaintance . | |
| 3,952,672 | 4/1976 | Gordon et al. . | |
| 4,397,246 | 8/1983 | Ishida et al. | 108/55.3 |
| 4,580,680 | 4/1986 | Wind | 108/55.3 X |
| 4,714,026 | 12/1987 | Yamaguchi et al. . | |
| 4,717,025 | 1/1988 | Maurer | 108/55.3 X |

FOREIGN PATENT DOCUMENTS

| | | | |
|---|---|---|---|
| 485397 | 8/1952 | Canada | 108/51.3 |
| 2503914 | 1/1975 | Fed. Rep. of Germany | 108/55.3 |
| 48-000694 | 1/1973 | Japan . | |
| 52-022756 | 6/1977 | Japan . | |
| 58-045227 | 10/1983 | Japan . | |

*Primary Examiner*—Peter A. Aschenbrenner
*Attorney, Agent, or Firm*—Fitzpatrick, Cella, Harper & Scinto

[57] ABSTRACT

A pallet for supporting articles comprising: a bottom plate member; a plurality of spacers fixedly arranged in n rows and m lines and having the same heights; a top plate member, on which an article or articles can be loaded, arranged on and fixed to the spacers and spaced apart from the bottom plate member by a predetermined distance; and a plurality of retainers provided for holding the spacers in each of the rows altogether and having upper and lower surfaces fixedly attached to the top and bottom plate members.

3 Claims, 15 Drawing Sheets

PALLET FOR SUPPORTING ARTICLE

BACKGROUND OF THE INVENTION

1. Field of the Invention

The present invention relates to a pallet for supporting an article, which can store and convey the article while supporting a predetermined weight of the article thereon.

2. Related Background Art

In the past, a pallet comprising a plate member and prismatic leg members fixed to an undersurface of the plate member has been used as a pallet for supporting and conveying an article. Both plate member and leg members were made of wood, and, accordingly, such conventional pallet was heavy and was not suitable to convey small and/or light-weighted articles. Further, as disclosed in the Japanese Utility Model Publication No. 48-694, a pallet comprising top and bottom main wall plates and a plurality of spaced cylindrical spacers fixedly arranged between the wall plates has been proposed. In addition, a pallet wherein such spacers are made of foam material has also been known. While such pallet comprising the wall plates and spacers had good resistance to pressure and/or load of the article supported thereon since the spacers were formed in the cylindrical configuration, adhesion strength between the top and bottom wall plates and the spacers was relatively weak because adhesion area between the wall plates and the spacers was small, and, thus, there arose a problem that the spacers were detached from the wall plates when the pallet had been used for a long time.

Regarding the leg members, the construction and/or material thereof have been devised or improved in various ways. For example, the Japanese Utility Model Publication Nos. 52-22756 and 58-45227 disclose a technique for increasing the stiffness of the leg members. However, in both cases, such improvements in the pallet made the construction of the pallet complicated, with the result that the pallet became heavy and expensive.

The pallet comprising a plate member and prismatic leg members fixed to an undersurface of the plate member is also disclosed in U.S. Pat. Nos. 2.996,276, 3,911,834, 3,952,672, 4,714,026.

The conventional wooden pallet has now been used widely since it has good resistance to load and has an adequate application condition. However, the price of wooden material has been increasing, and thus, the wooden pallet has become extremely expensive. Further, since the weight of the pallet itself is included in the transport weight determining the cost of transport of the articles, the reduction in the weight of the pallet itself leads to the reduction in the cost of transport directly. Accordingly, the reduction of the weight of the pallet is required.

Particularly, in case of exportation of the articles with the pallets by ship, the wooden pallets must sometimes be fumigated for the purpose of moth proofing according to the regulation of an importing country; this is an obstacle to the reduction in cost of the pallet. Further, in general, the pallets used in the exportation are scrapped in an importing country. The scrapping cost, which is cheaper than the recovery or returning cost, is not negligible. Accordingly, the reduction of such scrapping cost is also of concern.

In conclusion, as mentioned above, the conventional wooden pallets could not achieve the reduction of cost thereof adequately, and thus, are not economical.

Further, it is preferable to manufacture the pallet by paper material having various merits. However, if each of the leg members of the pallet is made of cylindrical paper material (cylindrical paper pipe), although adequate physical strength for usage of the pallet can be obtained, there is a problem in the connection or adhesion between the cylindrical paper pipes and the plate member of the pallet.

This is to say, in order to connect or fix the cylindrical paper pipes (leg members) to the plate member, an adhesive or fastener members such as staples can be used. However, when the adhesive is used, adequate adhesion strength cannot be obtained since the contacting area between the plate member and the cylindrical paper pipe is relatively small; on the other hand, when the fastener members are used, the fixing strength between the plate member and the cylindrical paper pipe is not sufficiently large.

SUMMARY OF THE INVENTION

Accordingly, an object of the present invention is to provide a pallet for supporting an article, which is lightweight, is inexpensive in the manufacturing cost thereof, does no have to be fumigated and is inexpensive to scrap.

Another object of the present invention is to provide a pallet wherein leg members (spacers) fixed to a plate member to separate the plate member from the ground are formed in a hollow cylindrical shape and prevent deformation and/or positional deviation of the spacers.

A further object of the present invention is to provide a pallet having a new structure comprising of a plate member on which an article is loaded or supported and leg members for separating the plate member from the ground, which can increase the fixing strength of the leg members when they are fixed to the plate member by means of retainer members surrounding the leg members.

A further object of the present invention is to provide a pallet which can obtain adequate fixing strength between the leg members and the plate member on which an article is supported even when they are made of paper material. Further, the present invention can solve a conventional problem that leg members must be positioned in the adhesing operation in place when the plate member and the leg members are manufactured independently.

Another object of the present invention is to provide a pallet wherein an article is not shifted on the pallet during transportation by directly fixing the article to the pallet and the article can be loaded on the pallet in laminated layers. To this end, according to the present invention, in the pallet on which the article is loaded, the article is loaded on an article receiving plate fixedly mounted on the top plate member of the pallet, and the article and the article receiving plate are interconnected by means of fixing members.

Further, in the pallet of the type wherein the article is loaded on the article receiving plate directed fixed on the top plate member of the pallet and the article and the article receiving plate are interconnected by means of the fixing member, in order that the pallet can be stored and/or transported in the laminated or stacked condition, side plates uprightly extending from the sides of the top plate member are provided, and the article fixed to the pallet is covered by a box-like member having a lid and a bottom opening, and the box-like member is fixed to the pallet by means of fastener members.

BRIEF DESCRIPTION OF THE DRAWINGS

FIGS. 1 to 6 show a preferred embodiment of the present invention, wherein:

FIG. 1 is a perspective view of a pallet for supporting articles according to the preferred embodiment of the present invention in a condition that package boxes as the articles are loaded thereon;

FIG. 2 is a plan view of the pallet of FIG. 1;

FIG. 3 is an elevational view of the pallet of FIG. 1;

FIG. 4 is a perspective view of a retainer member used with the pallet;

FIG. 5 is a development view of the retainer member showing a corrugated cardboard constituting the retainer member;

FIG. 6 is a plan view showing an alternation of a bottom plate member of the pallet;

FIGS. 8 to 11 show a second embodiment of the present invention, wherein:

FIG. 8 is an exploded perspective view of a pallet according to the second embodiment;

FIG. 10 is a side view of the pallet;

FIG. 11 is a partial sectional view taken along the line A1—A2 of FIG. 10;

FIGS. 12 to 15 show a third embodiment of the present invention wherein:

FIG. 12 is an exploded perspective view of a pallet according to the third embodiment;

FIG. 13 is a development plan view of a retainer member used with the pallet;

FIG. 14 is a side view of the pallet;

FIG. 15 is a sectional view taken along the line A2—A1 of FIG. 14;

FIGS. 16 to 20 show a fourth embodiment of the present invention, wherein:

FIG. 16 is a development view of a portion of a plate member of a pallet according to the fourth embodiment;

FIG. 17 is a development plan view of a retainer member used with the pallet;

FIG. 18 is a perspective view explaining the bending of an extension of the plate member and the retainer member, and showing leg members;

FIG. 20 is a sectional view taken along the line A1—A2 of FIG. 19A;

FIGS. 21 to 24 show a fifth embodiment of the present invention, wherein;

FIG. 21 is an exploded perspective view of a pallet according to the fifth embodiment, showing an article loading condition;

FIG. 22 is an exploded perspective view of a portion of a top plate member of the pallet, showing the details of an article receiving portion;

FIG. 23 is a development view of a cover member; and

FIG. 24 is a perspective view explaining the application condition of the pallets on which an article is loaded and which are laminated.

DESCRIPTION OF THE PREFERRED EMBODIMENTS

The present invention will now be fully explained in connection with embodiments thereof with reference to the accompanying drawings.

First of all, a first embodiment of the present invention will be explained with reference to FIGS. 1 to 6.

Figure 1:
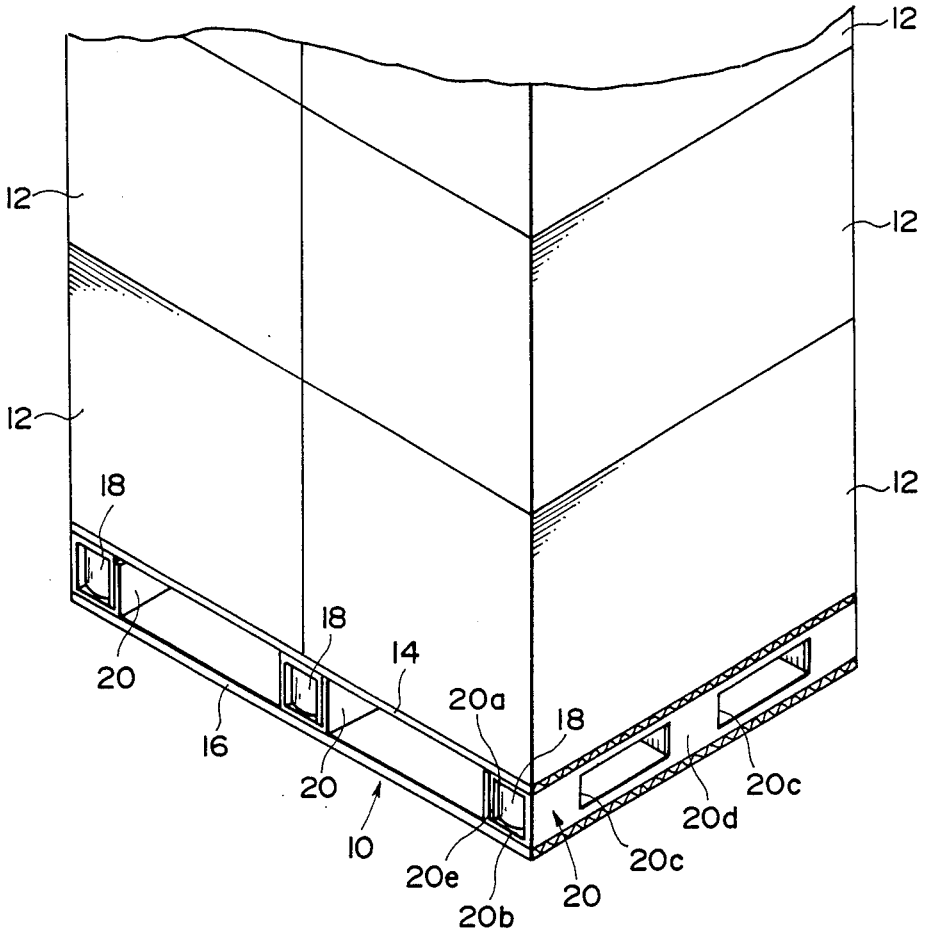

As shown in FIG. 1, a pallet 10 for supporting articles (referred to merely as "pallet" hereinafter) is used, for example, to convey a plurality of packages 12 in which the respective predetermined articles are accommodated. The illustrated example, the packages 12 are loaded on the pallet 10 in three laminated layers, each layer includes two packages. The pallet 10 on which a number of the packages 12 are loaded can be stored in a warehouse, or can be loaded or unloaded with respect to a loading space of a truck, or can be transported by a goods wagon or by ship. The pallet is made of paper material, particularly cardboard, as a whole. Incidentally, in order to increase the efficiency of the transportation, the packages 12 loaded on the single pallet 10 have the same configuration.

In the illustrated first embodiment, each package 12 is formed to include a bottom area having a dimension of 490 mm×729 mm, and thus, an upper area of the pallet 10 is selected to have a dimension of 980 mm×729 mm.

Figure 2:
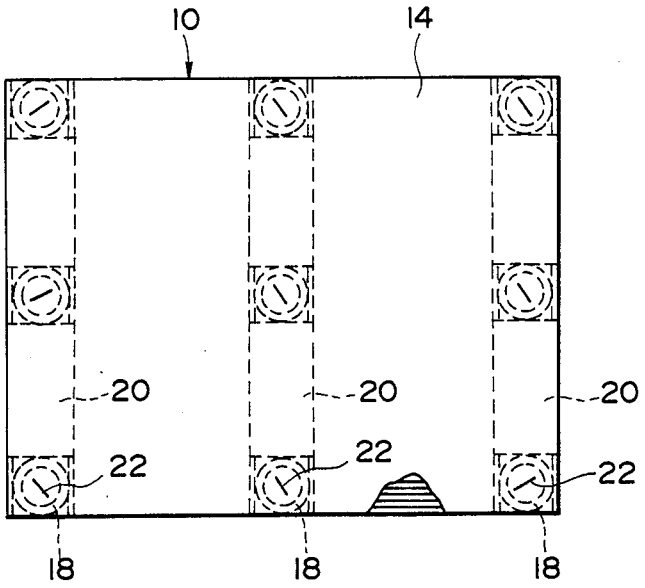
Figure 3:
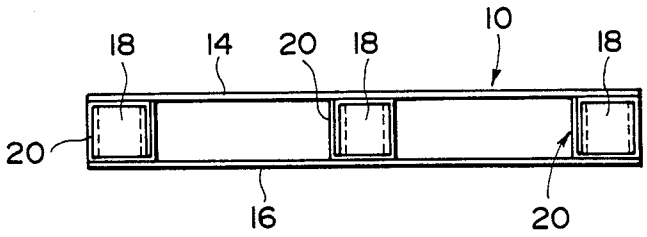

As shown in FIGS. 2 and 3, the palelt 10 comprises a top plate member 14, a bottom plate member 16 spaced apart from the top plate member in an up-and-down direction by a predetermined distance, and a plurality of (nine in this first embodiment) spacers 18 interposed between the top and bottom plates 14, 16. The nine spacers 18 are regularly arranged in three rows and three lines. The three spacers 18 in each row are fixedly positioned in a single retainer 20.

The top and bottom plate members 14 and 16 are made of dual-double-face corrugated cardboard (AB flute) K280/SCP125×3/K280, respectively, and are subject to a first water-proof treatment as described later. Here, the direction of the flute of each of the top and bottom plate members 14 and 16 is selected to extend in a longitudinal direction of the respective plate member (i.e., a direction parallel to a side having a length of 980 mm). Further, each spacer 18 is made of craft paper and is formed as a cylindrical paper pipe (having an outer diameter of 90 mm, inner diameter of 76 mm and length of 96 mm), and is subject to a second water-proof treatment as described later. Further, each retainer is made of double-face corrugated cardboard (B flute) K220/SC125/K220 and is subject to the same water-proof treatment as the top and bottom plate members 14, 16. As apparent from the above explanation, in the first embodiment, the top and bottom plate members 14 and 16 are arranged to be spaced from each other by 96 mm.

As shown in FIG. 2, the above-mentioned retainers 20 are attached to the top and bottom plate members 14, 16 to extend in the flute direction of the plate members, and other side surfaces of the left and right retainers 20 are aligned with the sides (having the length of 729 mm) of the plate members. Further, the central retainer 20 is positioned at the center of each plate member and extends transverse to the side (having the length of 980 mm) of the plate members. The central retainer 20 supports adjacent lower edge portions of the two packages 12 loaded on the pallet 10.

Figure 4:
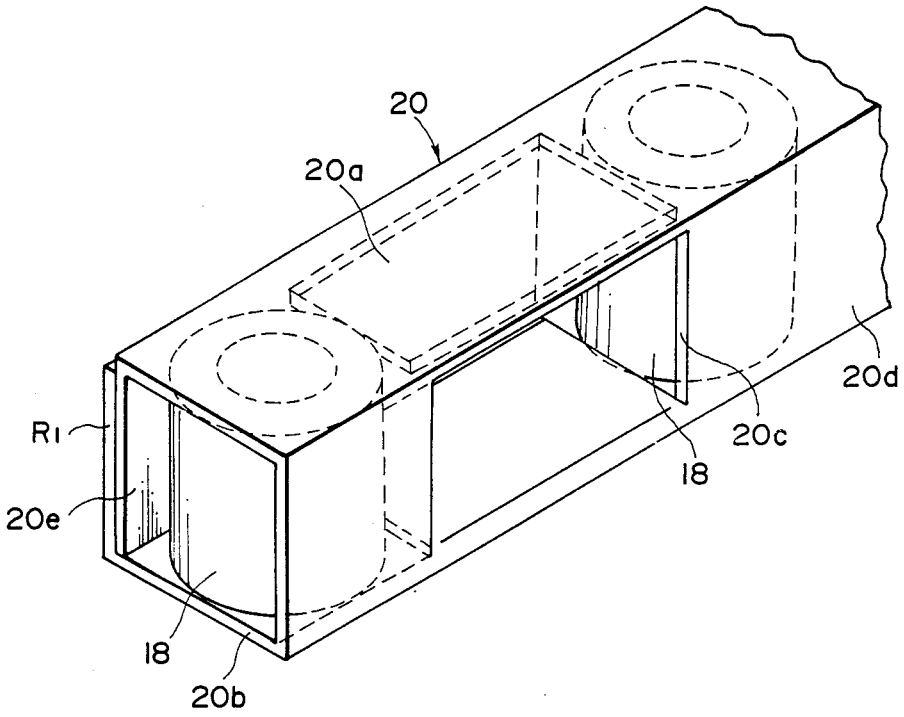

As shown in FIG. 4, each retainer 20 is formed by assembling and adhering a single cardboard P (FIG. 5) which will be described below. That is to say, each retainer 20 is constituted by a hollow body having a rectangular cross-section, and has an upper surface 20*a* adhered to an undersurface of the top plate member 14, a lower surface 20*b* adhered to an upper surface of the bottom plate member 16, and both side surfaces 20*d*, 20*e* having windows 20*c* provided at portions other than the portions for holding the spacers 18. The retainer 20 further has open ends.

Figure 5:
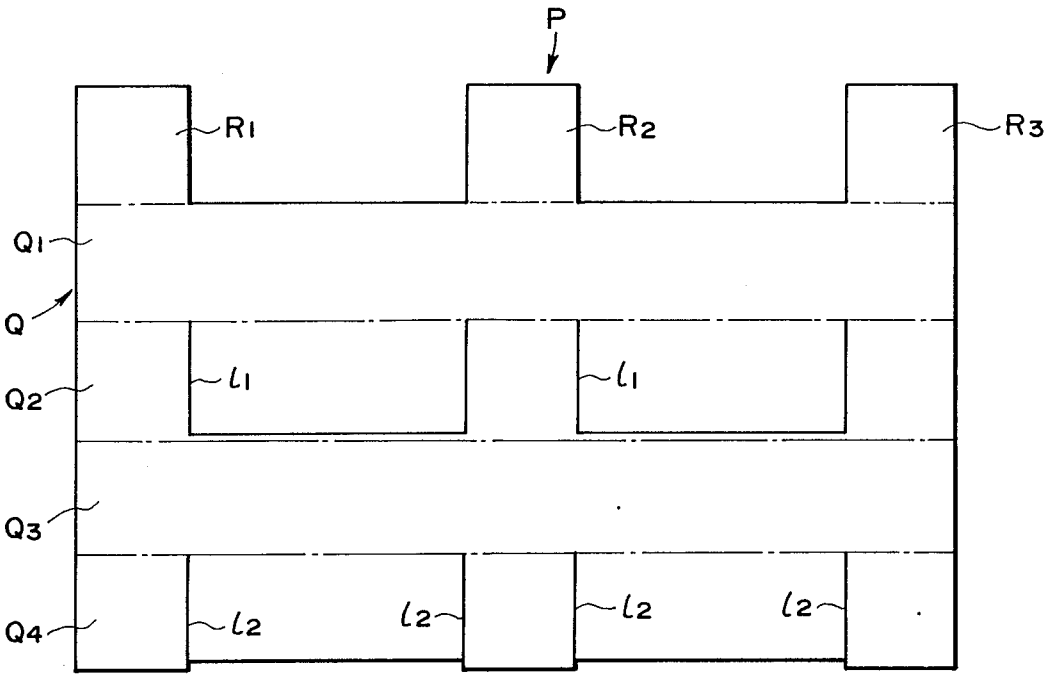
Figure 6:
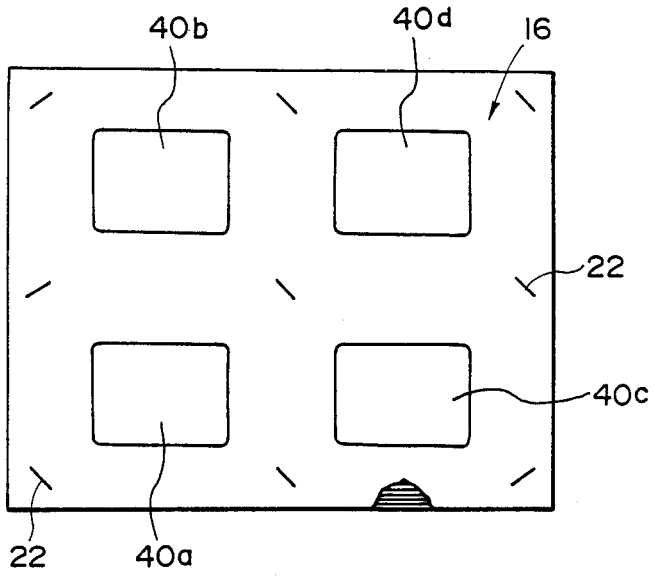

The configuration of the cardboard for forming the retainer 20 is selected as shown in FIG. 5. In an illustrated condition, one-dot chain lines show bending lines. More particularly, the cardboard P is so formed that the flute direction thereof extends in a bending direction, i.e., in a direction perpendicular to the flute direction of the plate members 14, 16 when the pallet is assembled as shown in FIG. 1. The cardboard P includes a substantially rectangular portion Q and three adhesion allowance portions $R_1$, $R_2$, $R_3$ equidistantly spaced apart from each other and integrally connected to one of longitudinal edges of the rectangular portion.

The rectangular portion Q includes four elongated paper areas $Q_1$, $Q_2$, $Q_3$ and $Q_4$ extending in the longitudinal direction of the cardboard. The elongated paper area $Q_1$ defines one of the longitudinal edges of the rectangular portion. The first elongated paper area $Q_1$ corresponding to the upper surface 20*a* or the lower surface 20*b* of the retainer 20 has no cut-out. The second elongated paper area $Q_2$ adjacent to the first elongated paper area $Q_1$ has a pair of U-shaped cut-out lines $l_1$ defining the windows 20*c* formed in the side surface 20*d* or 20*e* of the retainer 20.

The third elongated paper area $Q_3$ adjacent to the second elongated paper area $Q_2$ corresponds to the lower surface 20*b* or the upper surface 20*a* of the retainer 20 and has no cut-out. Further, the fourth elongated paper area $Q_4$ adjacent to the third elongated paper area $Q_3$ defines of the other longitudinal edge of the rectangular portion and corresponds to the side surface 20*e* or 20*d* of the retainer 20. The fourth elongated paper area $Q_4$ has four cut-out lines $l_2$ defining the windows 20*c* formed in the side surface 20*e* or 20*d* of the retainer 20.

When the cardboad P so formed is assembled to obtain the retainer 20, at first, the elongated paper areas $Q_1$, $Q_2$, $Q_3$ and $Q_4$ are bent along the bending lines to form a hollow prismatic body and the adhesion allowance portions $R_1$, $R_2$ and $R_3$ are overlapped to the fourth elongated paper area $Q_4$. Then, the adhesive is applied to the overlapped areas, thus adhering the adhesion allowance portions to the fourth elongated paper area. In this way, an outer profile of the retainer is obtained. Then, the portions of the elongated paper areas $Q_2$ and $Q_4$ defined by the cutout lines $l_1$ and $l_2$ and corresponding to the windows 20*c* in the side surfaces 20*d*, 20*e* are bent inwardly into the retainer to form the windows 20*c* as shown in FIGS. 1 and 4.

Next, an assembling method of the pallet 10 will be explained.

First of all, the spacers 18 are inserted in the both ends and central portion of the retainer 20 previously assembled as shown in FIG. 4 and are fixed to the retainer by means of the adhesive. Three retainers 20 constructed to include three spacers 18 are prepared. Here, the central spacer 18 is restrained, at both sides, by the bent portions bent inwardly along the cut-out lines $l_1$ and $l_2$ to form the windows 20*c*. As a result, the central spacer 18 is properly positioned in place and is prevented from shifting laterally (i.e., in the longitudinal direction of the retainer 20).

On the other hand, both end spacers 18 can be restrained, at their inner side, by the above-mentioned bent portions. Accordingly, by inserting both end spacers 18 into the retainer 20 until they abut against the corresponding bent portions, these end spacers 18 can be accurately positioned and are prevented from shifting inwardly.

Then, the three retainers 20 are fixed to the bottom plate member 16 by adhering the lower surfaces of the retainers to the upper surface of the bottom plate member at both left and right end positions and the central position thereof. Now, as shown in FIG. 2, each retainer 20 is arranged to extend in the flute direction of the plate members 14 and 16. In other words, the flute direction of each plate member 14, 16 coincides with the flute direction of each retainer 20.

Then, the upper surfaces of the retainers 20 so fixed to the bottom plate member 16 are adhered to the top plate member 14 by means of the adhesive. Thereafter, the retainers 20 are mechanically fastened to the top and bottom plate members 14, 16 at positions where the spacers 20 are arranged, by means of staples 22.

In this way, each retainer 20 are wholly fixed to the corresponding top and bottom plate members 14, 16 not only by the adhesive but also by the staples 22. Accordingly, since the fixing strength does not depend upon the adhesion strength of the adhesive alone, even if the adhesion strength is not partially adequate, the whole fixing strength can be properly maintained due to the fastening strength by means of the staples 22. On the other hand, since the fixing strength does not depend upon the mechanical fastening strength of the staples 22 alone, the cardboard constituting the pallet cannot be partially destroyed even when the excessive load acts on the pallet due to the presence of the adhesion strength by means of the adhesive, unlike the case where the retainers are fixed to the plate members only by the staples 22, thus providing adequate fixing strength.

Incidentally, in both end retainers 20, i.e., the retainers having the exposed side surface, in order to prevent the damage of such retainers in the case where tips of forks of a fork lift truck are forcibly entered into the overlapped portions of the retainer 20 (i.e., the adhered areas between the tips of the adhesion allowance portions $R_1$, $R_2$, $R_3$ and the fourth elongated paper area $Q_4$) when the forks are inserted into the pallet from one side of the pallet (for example, from the left in FIG. 2) other than from the front side of the pallet (i.e., from the lower side in FIG. 2), base portions of the adhesion allowance portions $R_1$, $R_2$, $R_3$ (i.e., portions adjacent to the bending lines) are positioned lower than the tips thereof.

More particularly, when the pallet 10 on which the packages 12 are loaded is lifted by the fork lift truck, the forks of the fork lift truck are inserted into the pallet 10 in a condition that the forks are slightly lifted above the ground; but, if the forks are not adequately lifted from the ground, the tips of the forks will strike against the lower edge of the retainer 20. However, in the first embodiment of the invention, as mentioned above, since, in the retainers having the exposed side surfaces, the tips of the adhesion allowance portions $R_1$, $R_2$, $R_3$ are positioned inwardly of the respective retainer, if the tips of the forks strike against the lower edge of the retainer 20, the adhesion allowance portions $R_1$, $R_2$, $R_3$ are not forcibly peeled by the forks.

Next, the first and second water-proof treatment mentioned above will be fully explained.

The water-proof treatment is carried out in order to eliminate the extreme reduction in strength of the cardboard due to the wetness of the same and to prevent uselessness of the cardboard, thus availing the various advantages of the cardboard such as lightness, cheapness and easiness of scrapping operation thereof. Now, the water-proof treatment is grouped into first and second categories according to the material to be treated (i.e., cardboard or craft paper).

That is to say, the first water-proof treatment is carried out for the cardboard material, and, briefly speaking, is effected by impregnating styrene group resin into the cardboard. In the first water-proof treatment, as a water-proof material, a mixture comprising polystyrene of 60 w % and petroleum resin of 40 w % is used. Now, as the petroleum resin, hydrocarbon resin having number of molecular of 800–2000 and a melting point of 60°–80° C. The mixture is introduced into a heating bath and heated at a temperature of 60° C. to melt the mixture, and thereafter, the cardboard to be impregnated is completely immersed into the molten mixture for 10–15 minutes.

Then, the cardboard removed from the heating bath is exposed in an atmosphere having a temperature of 40–60° C. for about an hour to remove the excessive polystyrene and the like by a dropping effect. Then, the cardboard is exposed in a heated atmosphere having a temperature of 110° C. for about two hours to dry the cardboard. Since the so dried resin-impregnated cardboard was dried too much, in order to supply the water component to the dried cardboard, finally, the cardboard is exposed in an atmosphere of high humidity for about an hour to make up for the necessary water component.

In this way, the cardboard is subject to the water-proof treatment.

On the other hand, the second water-proof treatment is carried out regarding the craft paper, rather than the cardboard, and, briefly speaking, is effected by impregnating parafin wax into the craft paper. In the second water-proof treatment, as a water-proof material, the parafin wax of 100% is used. The 100% parafin wax is introduced into a heating bath and is heated at a temperature of 80–100° C. to melt the parafin wax, and thereafter, the craft paper to be impregnated is completely immersed into the molten parafin wax for 20–30 seconds.

Then, the cardboard removed from the heating bath is exposed in a room temperature (temperature: 25° C., humidity: 65%) for four hours and then is exposed in a heated atmosphere having a temperature of 70–90° C. for two hours to remove the excessive wax by a dropping effect, thus setting the craft paper to include the wax of about 20–30 w %; at this point, the successive treatment processes have been completed.

In this way, the craft paper is subject to the water-proof treatment.

Accordingly, since the pallet 10 is subject to the water-proof treatment as a whole, even if the pallet on which a plurality of packages 12 are loaded is stored in a warehouse having high humidity for a long time, the pallet does not get wet, and accordingly, can keep the good pressure tightness.

As mentioned above, according to the illustrated embodiment, since the whole pallet 10 is made of paper material, the weight of the pallet can be reduced and the manufacturing cost thereof will be considerably cheap. Further, since no wooden material is used to construct the pallet, there is no need for fumigating the pallet. In addition, the pallet can be easily scrapped or disposed merely by burning up the pallet. In this way, the objects of the invention can be achieved.

Furthermore, according to the illustrated embodiment of the present invention, since the top and bottom plates 14 and 16 of the pallet 10 are made of cardboard material, the configuration and/or size thereof can be easily altered or changed. Consequently, the configuration and/or size of the pallet can also be freely selected in accordance with the size of the package 12 to be loaded, with the result that, by providing the pallet 10 having the same size as that of the bottom of the package 12, the storage space in the warehouse can be effectively used without useless space.

It should be noted that the present invention is not limited to the above-mentioned embodiment, but can be altered or modified in various ways without departure from the gist of the present invention.

For example, while in the above-mentioned embodiment the example that the nine spacers 18 are regularly arranged in three rows and three lines was explained, the number and arrangement of the spacers are not limited to such example; for example, the number of the spacers may be two or more, and is preferably three or more.

Further, as the above-mentioned water-proof treatment, a method for manufacturing a reinforced cardboard as disclosed in the Japanese Utility Model Publication No. 52-43862 may be used.

As explained above, the pallet for supporting an article according to the first embodiment of the present invention is characterized in that it comprises a bottom plate member, a plurality of spacers each having the same height and fixedly arranged in n rows and m lines on the bottom plate member, a top plate member on which the article is loaded and which is fixedly arranged on the spacers and spaced from the bottom plate member by a predetermined distance, and retainers each holding the spacers in the corresponding row altogether and each fixed, at its upper and lower surfaces, to the top and bottom plate members, respectively.

Therefore, the present invention provides a pallet for supporting an article, which is light-weight, is inexpensive to manufacture, does not need to be fumigated and is inexpensive in the scrapping or disposal cost.

Figure 7:
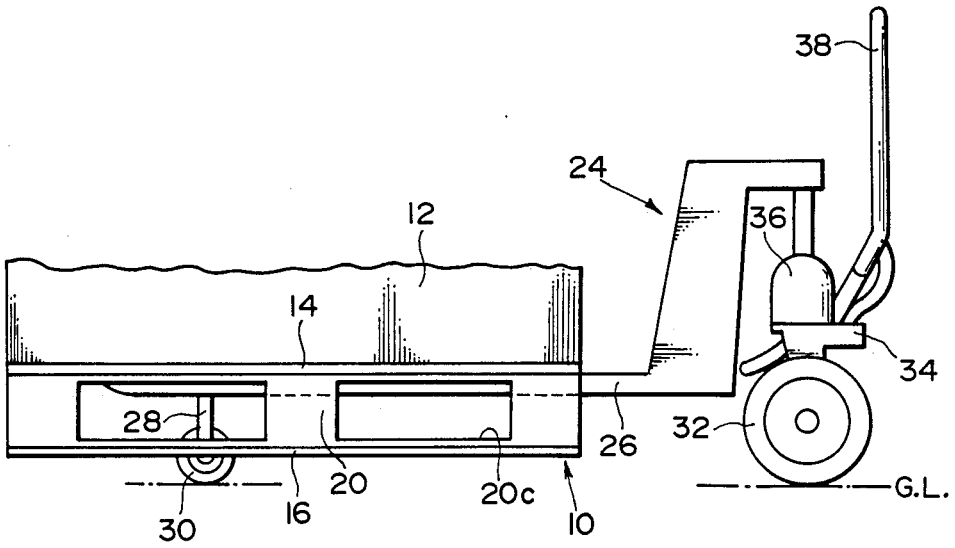
FIG. 7 is an elevational view of a tractor used for conveying the pallet according to the present invention.

FIG. 7 shows a main portion of a pallet truck for conveying the pallet shown in FIGS. 1 to 6.

The pallet truck 24 may be one of the conventional conveying machines and, thus, the detailed explanation thereof will be omitted. However, it is to be understood that the pallet truck 24 includes a pair of left and right forks 26. An auxiliary wheel 30 is rotatably mounted on a front back surface of each fork 26 through a corresponding foldable leg 28. Further, a common rear portion of the forks 26 is supported, through a hydraulic jack 36, by a body portion 34 on which main wheels 32 are rotatably mounted, whereby the forks can be lifted or lowered by manipulating a lift handle 38.

When it is desired to convey the pallet 10 by the pallet truck 24, after the forks 26 of the pallet truck 24 are inserted into the pallet 10, the forks 26 are lifted with respect to the body portion 34 by actuating the hydraulic jack 36 through the manipulation of the lift handle 38. Consequently, the top plate member 14 of the pallet 10 is lifted.

On the other hand, as shown in FIG. 7, the auxiliary wheels 30 mounted on the forks 26 of the pallet truck 24 are gradually swung from the folded position to an erect or upstanding position in response to the actuation of the hydraulic jack 36. The upstanding wheels 30 are contacted with the ground GL without being interfered with the bottom plate member 16 by passing through openings 40*a*, 40*b*, 40*c* and 40*d* (FIG. 6) formed in the bottom plate member. Accordingly, as the forks 26 are lifted, the pallet 10 is wholly elevated, thus separating the bottom plate member 16 from the ground GL as shown.

In this way, the pallet 10 is positively lifted from the ground and can be easily conveyed by means of the pallet truck 24 positioned on the ground through the main and auxiliary wheels 32 and 30.

Next, a second embodiment of the present invention will be explained with reference to FIGS. 8 to 11.

Figure 8:
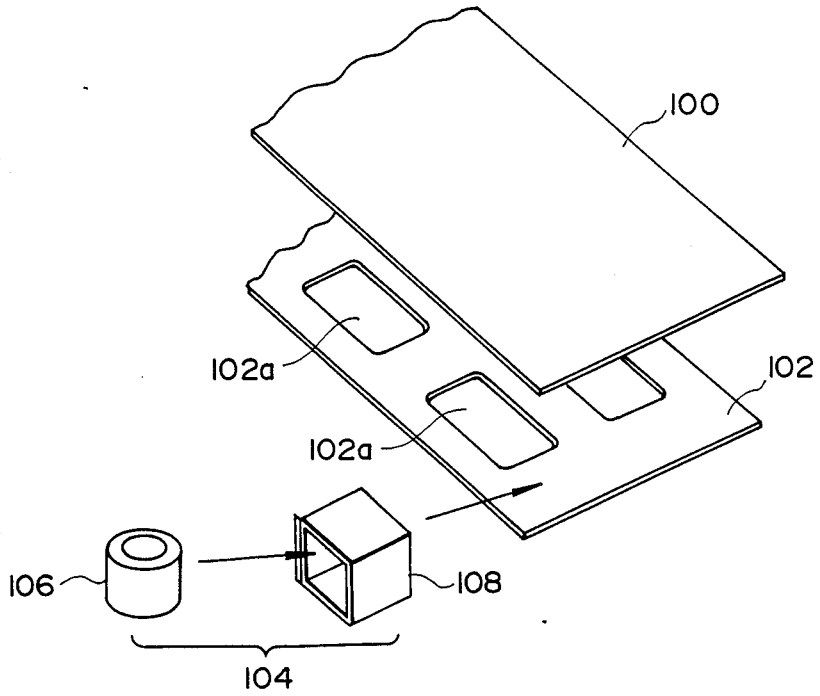
Figure 9A:
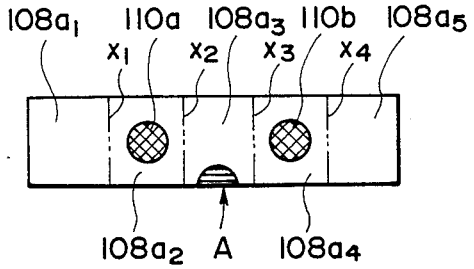
FIG. 9A is a development plan view of a retainer member used with the pallet.
Figure 9B:
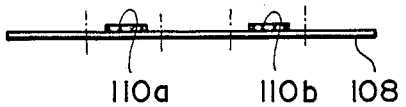
FIG. 9B a development side view of the retainer member.

FIG. 8 shows an exploded perspective view of a portion of a pallet according to the second embodiment. The pallet comprises a top plate member 100 on which an article is loaded, a bottom plate member 102, and spacers 104 each including a tubular member 106 and a retainer 108. The spacers 104 are inserted into the top and bottom plate members. The tubular member 106 may be obtained by cutting a pipe made of cardboard material. FIGS. 9A and 9B show a development of the retainer 108. As shown in FIG. 9A, the retainer 108 is made of a material bendable along bending lines $x_1$, $x_2$, $x_3$ and $x_4$. When the retainer is made of corrugated cardboard material, the bending lines is selected to extend in a direction perpendicular to the flute direction (direction parallel to the corrugations of the cardboard), as shown by a broken portion A in FIG. 9A. The retainer 108 has five faces 108$a_1$–108$a_5$ bordered by the bending lines. The both end faces 108$a_1$ and 108$a_5$ are overlapped with each other when the retainer material is assembled to form a hollow prismatic body. The faces 108$a_2$ and 108$a_4$ which constitute upper and lower surface of the retainer 108 have stoppers 110*a* and 110*b* for preventing the positional deviation of the tubular member 106, respectively. Each of the stoppers 110*a*, 110*b* comprises a disc plate fixed to the faces 108$a_2$, 108$a_4$ and having an outer diameter which is equal to an inner diameter of the tubular member.

Next, an assembling method of the pallet will be explained. First of all, the adhesive is applied to a lower end surface of the tubular member 106. Then, the tubular member is fitted onto the disc plate 110*a* on the face 108$a_2$ of the retainer material and is fixed to the face 108$a_2$ through the applied adhesive. Thereafter, the retainer material is bent along the bending lines $x_1$–$x_3$, whereas the adhesive is applied to an upper end surface of the tubular member 106. In this step, the disc plate 110*b* on the faces 108$a_4$ is fitted into the tubular member 106 from the top and, at the same time, said face 108$a_4$ is fixed to the upper end of the tubular member through the applied adhesive.

Figure 11:
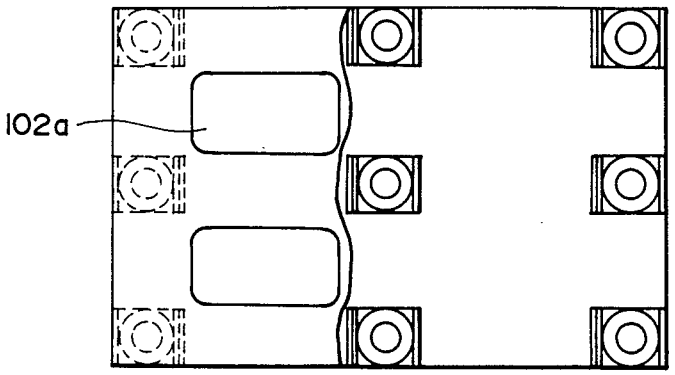

Then, the right end face 108$a_5$ of the retainer material is bent along the bending line $x_4$ to adhere it to the face 108$a_1$ by the adhesive. In this way, the spacer 104 is obtained. Nine spacers 104 so constructed are prepared. As shown in FIG. 11, the spacers 104 are arranged in three rows and three lines between the top and bottom plates 100 and 102 and are fixed thereto.

Figure 10:
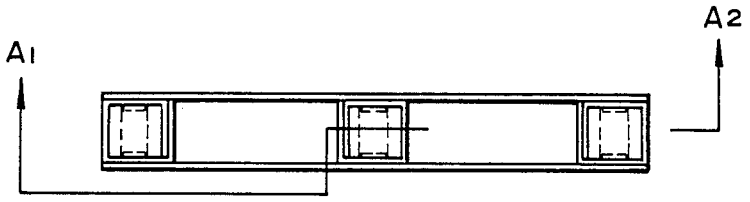

Incidentally, FIG. 10 shows a side view of the assembled pallet and FIG. 11 shows a section taken along the line $A_1$–$A_2$ of FIG. 10.

Rectangular openings 102*a* (FIGS. 8, 11) formed in the bottom plate member 102 has the same purpose as those of the openings 40*a*–40*d* in the previous embodiment and, accordingly, are used to permit the pallet to be lifted by the pallet truck and the like.

As mentioned above, according to the second embodiment of the present invention, since the retainer 108 enclosing the tubular member 106 which constitutes the spacer has stopper disc plates 110*a*, 110*b* for fixing the position of the tubular member 106, the positional deviation and deformation of the tubular member 106 can be effectively prevented.

Particularly, since the stopper disc plates 110*a*, 110*b* fittable into the tubular member 106 to be fixed are provided on the upper and lower faces 108$a_4$, 108$a_2$, by fitting the disc plates into the tubular member 106 when the latter is adhered to the faces 108$a_2$, 108$a_4$, it was found that the adhesion strength between the tubular member 106 and the faces of the retainer 108 was notably increased. This will effectively prevent damage of the pallet even in long term use. While in the second embodiment the example that each of the elements of the pallet was made of cardboard material, such elements may be made of plastic resin material or the like.

Next, a third embodiment of the present invention will be explained with reference to FIGS. 12 to 15.

Figure 12:
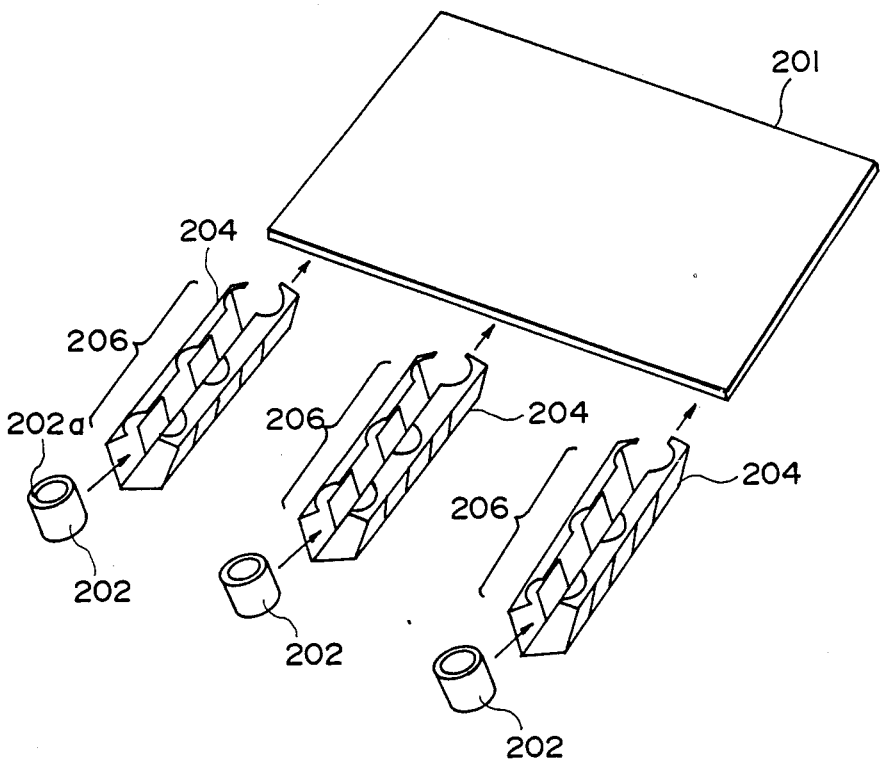
Figure 13:
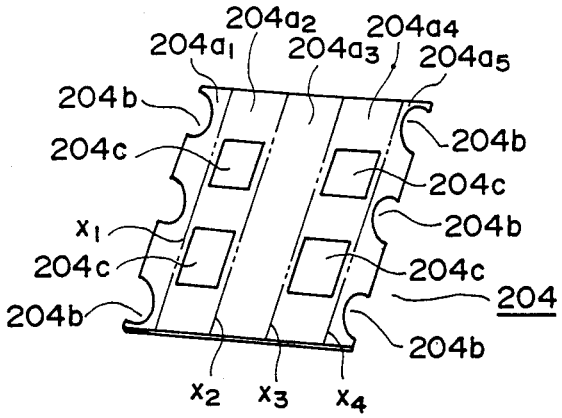

FIG. 12 is an exploded view of a portion of a pallet according to the third embodiment of the present invention, showing a top plate member 201, hollow tubular spacer members 202, and retainer members 204 for enclosing the spacer members. FIG. 13 shows a development of the retainer member 204. In FIG. 13, the retainer member 204 is made of foldable material such as a thick paper or a cardboard and includes five faces 204$a_1$–204$a_5$ bordered by bending lines $x_1$, $x_2$, $x_3$ and $x_4$. The retainer material is bent along the bending lines, as shown in FIG. 12, to form a hollow prismatic body.

Both end faces 204$a_1$ and 204$a_5$ of the retainer material 204 is provided, at its outer edge portion, with semicircular cut-outs or recesses 204*b* complementary to the cylindrical peripheral surface of the spacer member 202, whereas each of the faces 204$a_2$ and 204$a_4$ has through openings 204*c* formed therein, which through openings 204*c* are registered with each other when the retainer material is folded to face the faces 204$a_2$ and 204$a_4$ to each other.

Next, an assembling method of the pallet will be explained with reference to FIG. 12. The top plate member 201 is made of a thick paper or plastic material.

First of all, the spacer members 202 are obtained by cutting a cardboard pipe by a predetermined length. Three spacers 202 are arranged in line on the central face 204$a_3$ of the retainer material 204 (FIG. 13) and are fixed, at their lower end, to said face.

Then, the retainer material having the spacer members 202 fixed thereon is folded along the bending lines $x_1$–$x_4$ to enclose the spacer members and to fit the semicircular recesses 204*b* in the end faces 204$a_1$, 204$a_5$ onto the outer cylindrical surfaces of the spacer members 202.

A width (height) of each of the faces 204$a_2$, 204$a_4$ which constitute the opposite side walls of the completed retainer 204 is selected to be the same as the length of each spacer member 202 so that, when the retainer 204 is assembled, an upper end surface 202*a* of each spacer member 202 flushes with the folded faces 204$a_1$, 204$a_5$ of the retainer member 204.

Further, the spacer members 202 are fixed to the faces 204$a_3$, 204$a_1$, 204$a_5$ at positions where the spacer members are not interfered with the through openings 204*c* when the retainer 204 is assembled, and accordingly, the registered through openings 204*c* formed in the faces 204$a_2$, 204$a_4$ are free from the spacer members.

Figure 14:
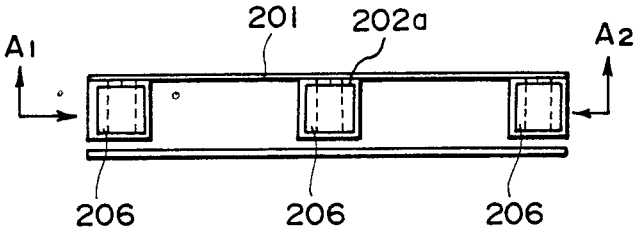

As shown in FIG. 14, the retainer members 204 each including the spacer members 202 therein act as leg members 206.

Figure 15:
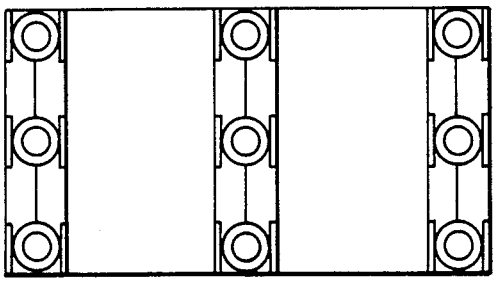
Figure 16:
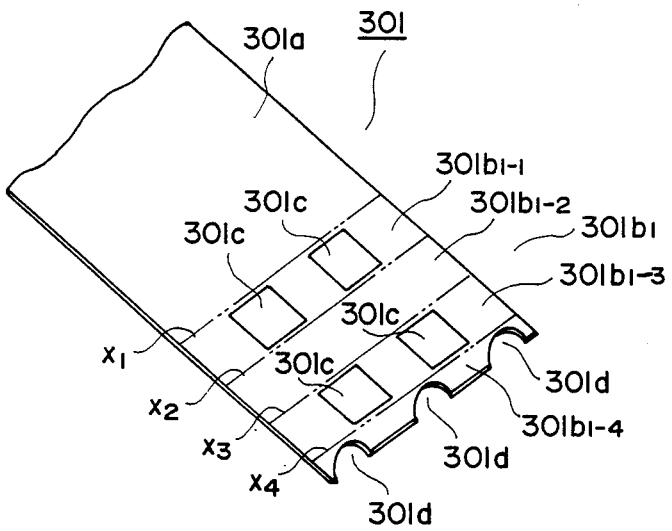

The adhesive is applied to an upper surface of each leg member 206 and to a lower surface of the top plate member 201, respectively. In this way, the leg members 206 are adhered to the lower surface of the top plate member 201. FIG. 14 shows a side view of the pallet wherein the leg members 206 are fixed to the top plate member 201, and FIG. 15 shows a section taken along the line $A_1$–$A_2$ of FIG. 14.

The above-mentioned top plate member 201, spacer members 202 and retainer members 204 constituting the pallet may be made of appropriate material. For example, if the articles to be loaded and transported are lightweight, such members all may be made of thick paper material such as a cardboard; or, only the spacers 202 may be made of the cardboard and the top plate 201 and the retainers 204 may be made of plastic material.

The length (height) of the spacer member 202 can be determined according to a desired height of the pallet when it is supported on the ground, and a wall thickness of the spacer member can be determined in consideration of the total weight of the article to be supported by the spacers.

According to the third embodiment of the present invention, since the spacer members are enclosed by the corresponding retainer member, and the folded faces 204$a_1$ and 204$a_5$ are abutted against each other to enclose the spacer members through the semicircular recesses 204*b* so that the upper surface of the assembled retainer member 204 flushes with the upper end surface of each spacer member 202, thus fixing the spacers and the retainers simultaneously to the top plate member, the adhesion strength can be increased.

In this third embodiment, when the adhesive is also applied to edge surfaces of the semi-circular recesses 204*b* to be abutted against the outer cylindrical surface of each of the spacer members 202, the adhered area will be further increased.

Further, in the third embodiment, since the registered through openings 204*c* are formed in the opposed side walls 204$a_2$, 204$a_4$ of the retainer member 204, the forks of the pallet truck or fork lift can be inserted into these through openings. As a result, the forks of the pallet truck can be inserted into the pallet from all of four sides of the pallet. While in the third embodiment, the example that the spacer member 202 comprises the hollow tubular member was explained, the spacer member may comprise a hollow prismatic body and the recesses 204*c* in the retainer material 204 may be correspondingly semi-rectangular.

Next, a fourth embodiment of the present invention will be explained with reference to FIGS. 16 to 20.

A pallet according to the fourth embodiment includes a plate member 301 on which an article is loaded.

Figure 18:
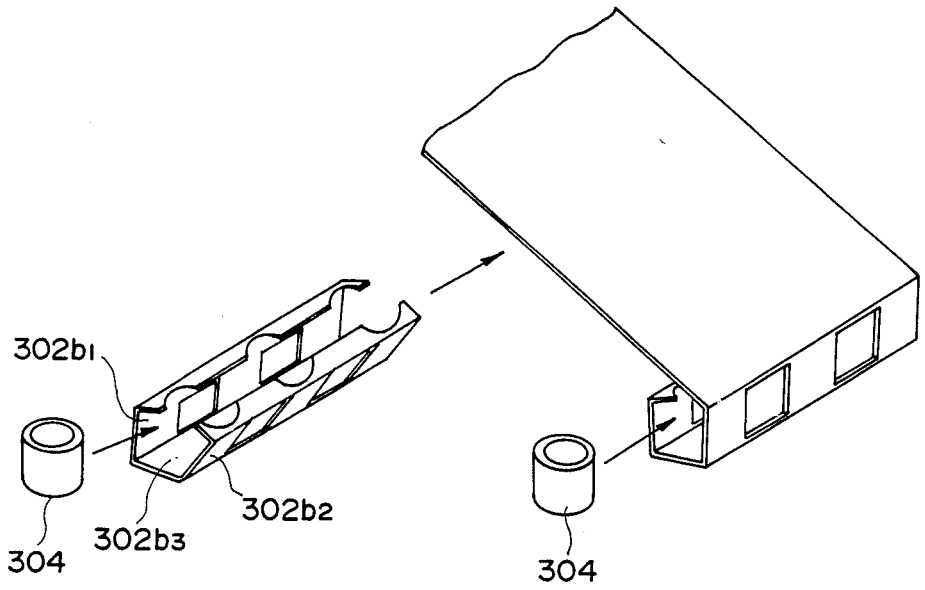

The plate member 301 has a supporting portion 301*a* by which the article is supported, and extensions 301$b_1$ and 301$b_2$ positioned on both end of the supporting portion 301*a* (only the extension 301$b_1$ is shown). The extensions 301$b_1$ and 301$b_2$ each constitute an enclosing portion for enclosing cylindrical paper pipes 304 described later, and each is bendable along bending lines $x_1$–$x_4$ as shown in FIG. 18.

Faces 301$b_{1\text{-}1}$, 301$b_{1\text{-}2}$, 301$b_{1\text{-}3}$ and 301$b_{1\text{-}4}$ bordered by the bending lines of the extension 301$b_1$ constitute an outer side surface, a base surface, an inner side surface and an overlapped surface, respectively.

Figure 17:
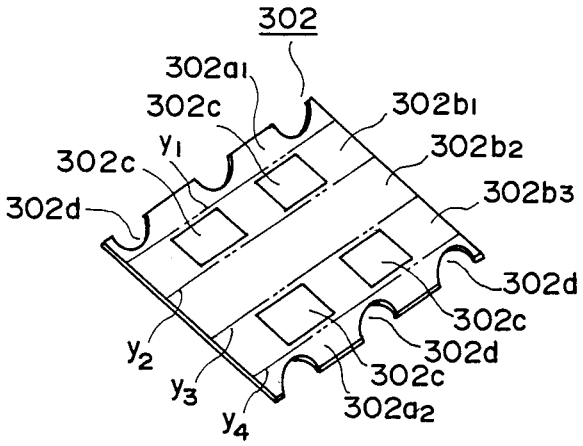

The outer side surface 301$b_{1\text{-}1}$ and the inner side surface 301$b_{1\text{-}3}$ have through openings 301*c* formed therein. The overlapped surface 301$b_{1\text{-}4}$ is provided, at its outer edge portion, with semi-circular recesses 301*d* which can fit onto an outer cylindrical surface of each cylindrical paper pipe 304 described later. FIG. 17 shows a development of a retainer member 302. The retainer member is made of foldable material which can be bend along bending lines $y_1$–$y_4$.

Faces 302$a_1$ and 302$a_2$ outside of the bending lines $y_1$ and $y_4$ are folded to abut against each other so that these faces flush with each other, and these faces are provided, at their outer edge portions, with semi-circular recesses 302*d* for fitting onto the outer cylindrical surface of the cylindrical paper pipe 304 described later.

Faces 302$b_1$ and 302$b_3$ have through openings 302*c* formed therein.

FIG. 18 shows an assembling processes of the pallet. First of all, three cylindrical paper pipes 304 are fixed to the face 301$b_{1\text{-}2}$ of each of the extensions on both sides of the plate member 301 by the adhesive, and then the extensions are folded along the bending lines to enclose the three cylindrical paper pipes 304 as shown in FIG. 18.

The adhesive is applied to the upper surface of the overlapped face 301$b_{1\text{-}4}$ and the upper end surfaces of the cylindrical pipes 304, and to the corresponding area on the lower surface of the plate member, thus adhering the overlapped face and the cylindrical paper pipes to the plate member.

The through openings 301*c* formed in the outer side surface 301$b_{1\text{-}1}$ and the inner side surface 301$b_{1\text{-}3}$ are aligned with each other when the extension 301$b_1$ is completely folded. The other extension (301$b_2$; not shown) is similarly folded to include the cylindrical paper pipes fixed thereto.

On the other hand, three other cylindrical paper pipes 304 are fixed to the central face 302$b_3$ of the retainer material 302 by the adhesive, and then, the retainer material is folded along the bending lines in order. In the folded condition, the semicircular recesses 302*d* formed in the both end faces 302$a_1$ and 302$a_2$ are fitted onto the outer cylindrical surfaces of the cylindrical paper pipes at the upper end of the pipes. Then, the adhesive is applied to the outer surfaces of the end faces 302$a_1$ and 302$a_2$ of the retainer 302 and to the upper end surfaces of the cylindrical paper pipes 304, and, thereafter, these members 302 and 304 are adhered to a central portion of the lower surface of the plate member 301 shown in FIG. 18.

Figure 19B:
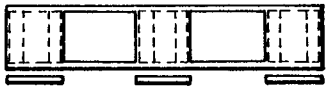
FIG. 19B is an elevational view of the pallet.
Figure 19A:
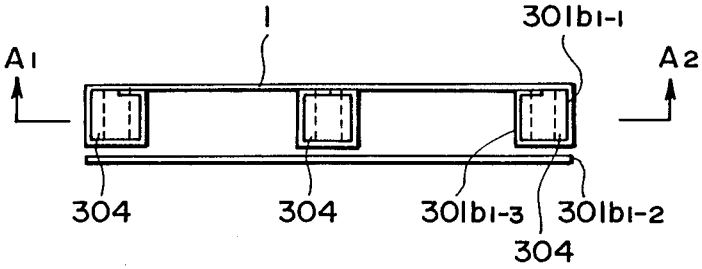
FIG. 19A is a side view of the pallet.
Figure 20:
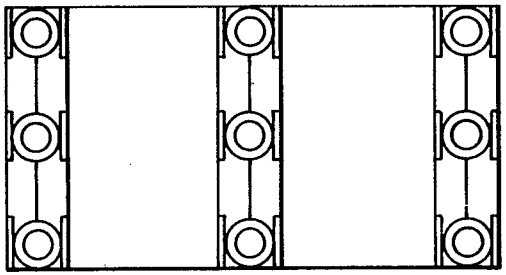

FIGS. 19A, 19B show a side view and an elevational view of the assembled pallet, and FIG. 20 shows a section taken along the line $A_1$–$A_2$ of FIG. 19A.

In this fourth embodiment, the material of the plate member 301 and the retainer member 302 of the pallet may be appropriately selected in accordance with the weight and/or size of the article which is loaded on the pallet; however, a foldable material, particularly cardboard material is preferable in view of its low cost and ease to work with. Of course, plastic resin material may be used, if necessary.

The cylindrical paper pipe 304 may be made of plastic resin material or paper material so long as it has good adhesion property to the plate member 301 through the adhesive; however, preferably, the cylindrical paper pipes are made of a thick paper such as cardboard in view of the low cost and workability.

According to the pallet so assembled as shown in FIGS. 19A, 19B and 20, since leg members positioned on both ends of the plate member are constituted by the extensions 301$b_1$, 301$b_2$ folded to enclose the cylindrical paper pipes 304 therein, the pressure from the article loaded on the plate member is transmitted from the plate member to the cylindrical paper pipes 304. Since the cylindrical paper pipes 304 have adequate strength to buckling by appropriately selecting the length, diameter and thickness thereof, the leg members can bear the higher load.

Further, in the pallet according to this fourth embodiment, since the pallet can be obtained only by blanking the through openings 301*c* and the semicircular recesses 301*d* in the foldable extensions, by blanking the through openings 301*c* and the semicircular recesses 301*d* in the retainer material 302, by folding the extensions of the retainer material and by adhering the cylindrical paper pipes and the retainer as mentioned above, the manufacture of the pallet can be simplified.

In addition, since the cylindrical paper pipes are firmly held in the semi-circular recesses in the assembled condition as well as they are adhered to the retainer and plate member, the positional deviation of the cylindrical paper pipes can be effectively prevented, thus providing adequate durability and strength.

Furthermore, in the pallet according to the fourth embodiment, by forming the through openings 301*c*, 302*c* in the extensions 301$b_1$, 301$b_2$ of the plate member 301 and in the retainer material 302 by the blanking operation, the assembled pallet is provided, at its opposed side walls, with alignment through openings. Accordingly, the forks of the pallet truck or fork lift truck can be inserted into the pallet from all four sides of the pallet as a whole (i.e., from both sides through the aligned through openings, and from front and rear sides between the rows of the cylindrical paper pipes), whereby the pallet can be conveyed in any direction regardless of the direction of the article loaded on the pallet by means of the pallet truck. While in the fourth embodiment shown in FIGS. 16 to 20 the example that the through openings 301*c* and 302*c* were formed in the extension of the plate member and in the retainer was explained, these through openings may appropriately be formed, and, if the forks are inserted into the pallet only from the front or rear side of the pallet, the through openings can be omitted.

Finally, a fifth embodiment of the present invention will be explained with reference to FIGS. 21 to 24.

In these Figures, the pallet 401 comprises a top plate member 402 and a bottom plate member 404, between which a plurality of spacers 406A, 406B and 406C are arranged through which the top and bottom plate members 402 and 404 are interconnected. The spaces between the top and bottom plate members 402 and 404 defined by the spacers 406A, 406B and 406C form fork insertion openings for receiving the forks of the pallet truck.

Figure 22:
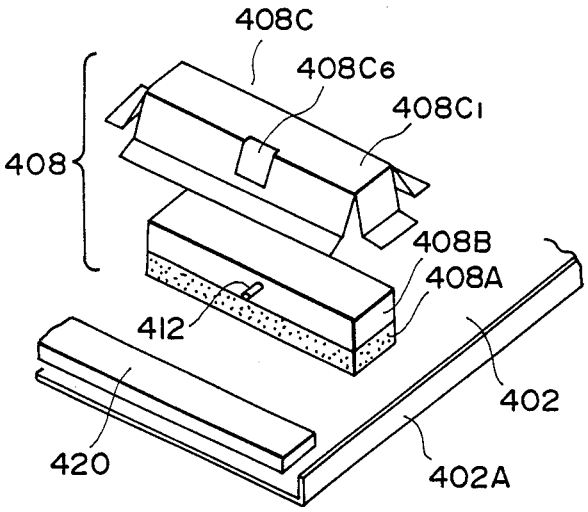
Figure 23:
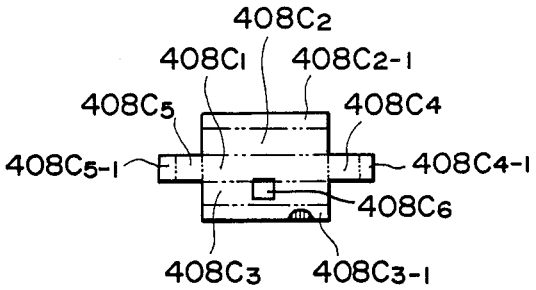

As shown in FIG. 22, two article receivers 408 are provided. Each of the article receivers 408 comprises a cushioning member 408A in the form of elastic plate-shaped or prismatic body made of foam polyetylene or the like, an article receiving member 408B made of hard material such as wood, by which the article is supported directly, and a cover member 408C for fixing the cushioning member 408A and article receiving member 408B to the top plate member 402. The cover member 408C is made of paper material such as cardboard, fiber material or thin film resin material, and is shaped to include a central face 408$C_1$ abutted against the article receiving member 408B, two side faces 408$C_2$, 408$C_3$ abutted against side surfaces of the cushoning member 408A and article receiving member 408B, respectively, adhesion faces 408$C_{2\text{-}1}$, 408$C_{3\text{-}1}$, extending from the side faces and adhered to the top plate member 402, end faces 408$C_4$, 408$C_5$ abutted against end surfaces of the article receiving member and cushioning member, and adhesion faces 408$C_{4\text{-}1}$, 408$C_{5\text{-}1}$ extending from the end faces 408$C_4$, 408$C_5$ and adhered to the top plate member 402, as shown in FIGS. 22 and 23. A stud bolt 412 is fixed to the side surface of the article receiving member 408B to protrude therefrom perpendicular thereto.

The cushoning member 408B and the article receiving member 408C are arranged in place on the top plate member 402, the adhesive is applied to the adhesion faces 408$C_{2\text{-}1}$, 408$C_{3\text{-}1}$, 408$C_{4\text{-}1}$ and 408$C_{5\text{-}1}$ of the cover member 408C, and the cover member is attached to the top plate member 402 by adhering the adhesion faces to the top plate member in such a manner that an upper surface of the article receiving member is held by the central faces 408$C_1$ and the side and end surfaces of the cushioning member and article receiving member are held by the side faces 408$C_2$, 408$C_3$ and end faces 408$C_4$, 408$C_5$ to enclose the cushioning member 408B and article receiving member 408C. The cover member 408C further includes an opening 408$C_6$ for permitting the stud bolt 412 to pass therethrough.

Figure 21:
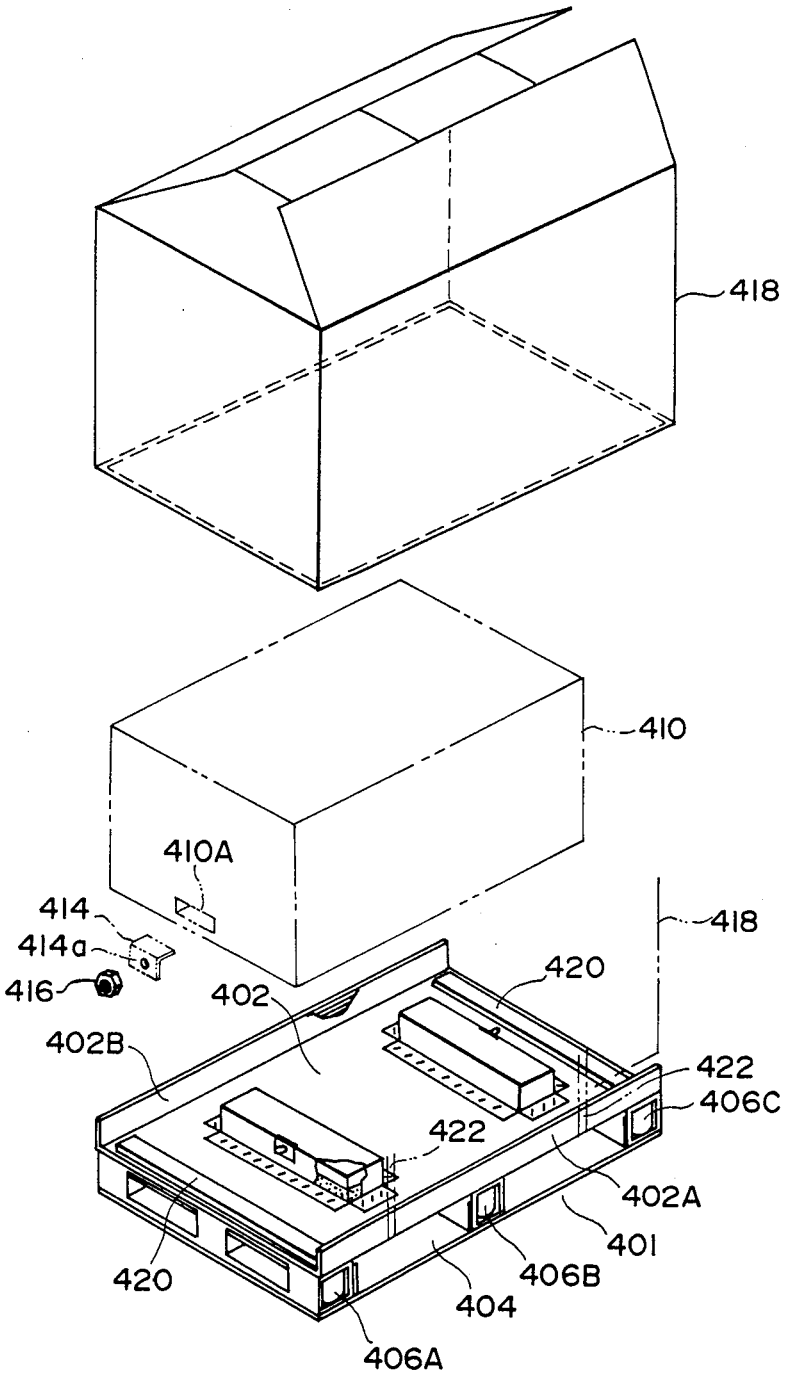

FIG. 21 further shows an appearance of the article 410. The article 410 includes a fixing holes 410A. The reference numerals 414 and 416 designate an L-shaped member and a nut for fastening the article 410 to the article receiver 408.

The reference numeral 418 designates an article accommodating box made of cardboard material or the like. The article accomodating box 418 has four side walls and a top lid, but has no bottom. When the box 418 is positioned on the pallet, lower ends of the side walls of the box are restrained by upright side plates 402A and 402B upstanding from side edges of the top plate member 402.

Further, the article accommodating box 418 positioned on the pallet is preventing from shifting in a longitudinal direction thereof by means of stoppers 420 provided on the ends of the top plate member 402.

In use, the article 410 is loaded on the article receivers 408. Then, one end of the L-shaped member 414 is inserted into the hole 410A of the article and, at the same time, a small hole formed in the L-shaped member 414 is inserted onto the stud bolt 412, thereafter the nut is tightened. This operation is effected regarding the fixing holes 410A on both ends of the article. In this way, the article 410 is fixed to the top plate member 402 of the pallet.

Then, the article 410 is covered by the bottomless box 418 from the top. The bottom side edges of the bottomless box is restrained by the upright side plates 402A, 402B of the top plate member 402 and the longitudinal movement of the box is prevented by the stoppers 420.

After the article is covered by the accommodating box 418, by encircling the top plate member 402 and the accommodating box with fastening bands 422, the box is integrally fixed to the pallet.

As mentioned above, according to the fifth embodiment of the present invention, since the article is directly fixed to the top plate member 402 of the pallet 401, the article is effectively prevented from shifting, during transportation and/or storage thereof.

Further, in the illustrated embodiment, since each article receiver 408 comprises elastic cushioning member 408A and the hard article receiving member 408B, the article is effectively prevented from damage due to cushion effect of the cushioning member even if the article is subject to an external force. In particular, according to the illustrated embodiment, since the cushioning member and the article receiving member are not directly fixed to the top plate member, but are held by the cover member 408C in an enclosed condition, the abutting condition between the cushioning member and the article receiving member is varied in accordance with the mode of the external force acting on the article, and, thus, the restoring force is obtained (to return the cushioning member and article receiving member to their original shapes) by such variation, thereby stably holding the article on the pallet.

Figure 24:
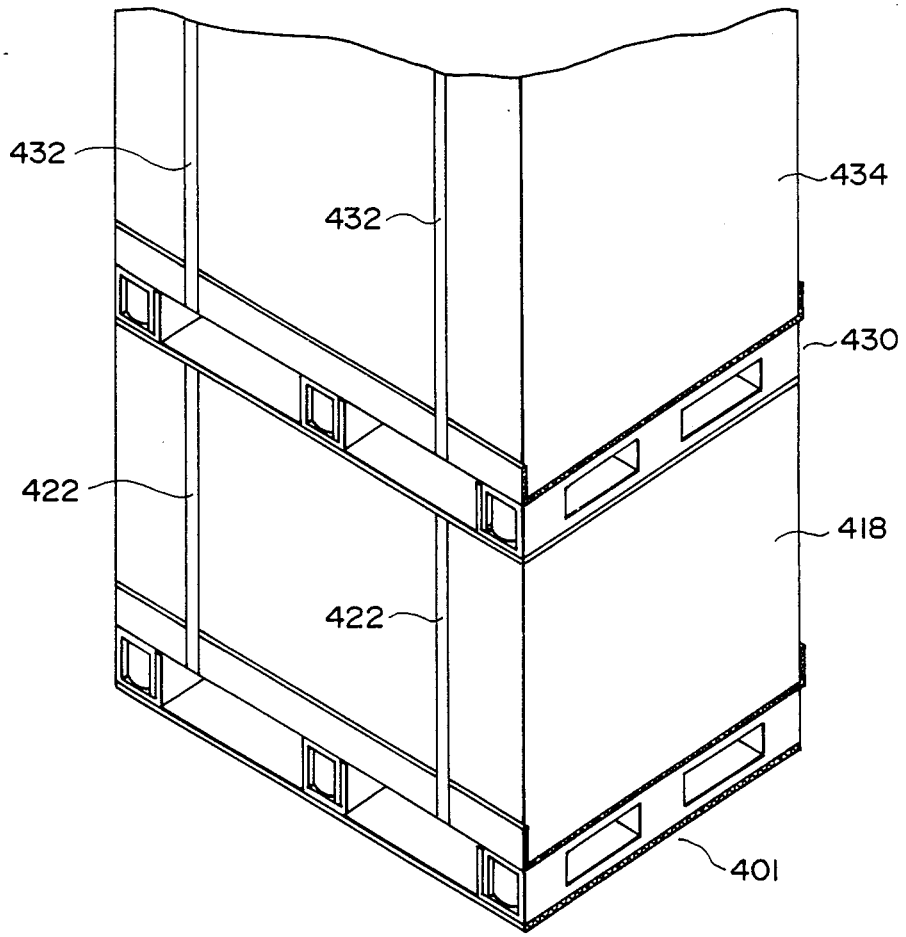

In addition, in the illustrated embodiment, since the article 410 is covered by the bottomless box 418 from the top after the article is fixed to the top plate member of the pallet 401, as shown in FIG. 24, a second similar pallet 430 on which an accommodating box 434 fastened to the pallet by means of fastening belts 432 is loaded can be laminated on the first pallet 401 on which the accommodating box 418 fastened to the pallet by the fastening belts 422, thus permitting the loading of the plurality of articles in the stable laminated condition.

What is claimed is:

1. A pallet for supporting articles comprising:

an upper plate member for supporting the articles;

a lower plate member spaced apart form said upper plate member;

retainers secured between said upper plate member and said lower plate member; and cylindrical spacers, having an upper and lower end, housed in said retainers for supporting said upper plate member, wherein said retainers include a bottom surface bordered by an outer side surface and an inner side surface, and a first folding surface adjacent to said outer side surface and a second folding surface adjacent to said inner side surface, wherein said first and second folding surfaces include semi-circular cut-out portions corresponding to an outer periphery of said cylindrical spacers, and wherein said retainer is folded to form a hollow housing to house said spacers and said semi-circular cut-out portions are flush with said upper end of spacer, and said first and second folding surfaces and said upper end of said spacers are fixed to said upper plate member.

2. A pallet for supporting articles comprising:

an upper plate member for supporting articles, said plate member including retaining means for housing supporting members; and cylindrical spacers provided in said retaining means for supporting said upper plate member, wherein said retaining means includes a portion extending from opposite sides of said upper plate member, each said portion including an outer side surface, a ground side surface, an inner side surface, and a folding surface having semi-circular cutout portions corresponding to an outer periphery of said cylindrical spacers, wherein said portions are folded to form a housing to retain said spacers.

3. A pallet arrangement for receiving articles, comprising;

a pallet including a top plate member and side plates extending upwardly from said top plate member;

article receiving means secured to said top plate member for supporting the articles received on said pallet, said receiving means including a cushioning member in contact with said top plate member, a hard article receiving member stacked atop said cushioning member, and a cover member to fix said cushioning member and article receiving member to said top plate member;

a fixing member for fixing the article to said article receiving means;

a bottomless box for covering the article fixed to said article fixing means; and fastening means to secure said bottomless box to said pallet.

* * * * *

UNITED STATES PATENT AND TRADEMARK OFFICE

CERTIFICATE OF CORRECTION

PATENT NO. : 4,966,084

DATED : October 30, 1990

INVENTOR(S) : Akira Motomaru

It is certified that error appears in the above-identified patent and that said Letters Patent is hereby corrected as shown below:

COLUMN 4:

Line 31, "palelt" should read --pallet--.

COLUMN 14:

Line 4, "polyetyline" should read --polyethyline--.

COLUMN 16:

Line 27, "cutout" should read --cut-out--.

Signed and Sealed this

Sixteenth Day of June, 1992

*Attest:*

DOUGLAS B. COMER

*Attesting Officer*

*Acting Commissioner of Patents and Trademarks*